US011111067B2

(12) United States Patent
Varriano-Marston

(10) Patent No.: US 11,111,067 B2
(45) Date of Patent: Sep. 7, 2021

(54) PACKAGE FOR STORING AND COOKING FOOD WITH TEMPERATURE-ACTIVATED VENTILATION

(71) Applicant: MarstonMAP, LLC, Windham, NH (US)

(72) Inventor: Elizabeth Varriano-Marston, Windham, NH (US)

(73) Assignee: MarstonMAP, LLC, Windham, NH (US)

( * ) Notice: Subject to any disclaimer, the term of this patent is extended or adjusted under 35 U.S.C. 154(b) by 265 days.

(21) Appl. No.: 16/002,507

(22) Filed: Jun. 7, 2018

(65) Prior Publication Data

US 2019/0023478 A1 Jan. 24, 2019

Related U.S. Application Data

(60) Provisional application No. 62/535,027, filed on Jul. 20, 2017.

(51) Int. Cl.
*H05B 6/80* (2006.01)
*B65D 81/34* (2006.01)
(Continued)

(52) U.S. Cl.
CPC ..... *B65D 81/3461* (2013.01); *B65D 33/004* (2013.01); *B65D 2205/025* (2013.01);
(Continued)

(58) Field of Classification Search
CPC ..... B65D 81/3461; B65D 33/004; B65D 2581/3445; B65D 2581/3427; B65D 2581/3497; B65D 2205/025
(Continued)

(56) References Cited

U.S. PATENT DOCUMENTS 4,210,674 A 7/1980 Mitchell
4,640,838 A * 2/1987 Isakson ..... B65D 81/3461 426/107
(Continued)

FOREIGN PATENT DOCUMENTS

EP 0218419 A1 4/1987
JP 3157394 U 2/2010
(Continued)

OTHER PUBLICATIONS

PCT Search Report for Appl No. PCT/US18/36439 dated Jul. 31, 2018, 14 pages.
(Continued)

*Primary Examiner* — Quang T Van
(74) *Attorney, Agent, or Firm* — Maine Cernota & Rardin

(57) ABSTRACT

A package suitable for storing and cooking foods without user manipulation includes a venting mechanism actuated primarily or exclusively by temperature, rather than pressure. A vent hole can be sealed by a patch attached by a thermoplastic adhesive having a selected, well characterized Tg, or the patch itself can be a thermoplastic polymer having a selected Tg. The patch can be convection-heated, or a microwave absorbing susceptor material can be applied to the adhesive or patch for direct microwave heating. The patch can include a region that is melted by convection or by a susceptor material. A porous patch can be sealed by a low melting temperature polymer or by thermally sensitive ink. And/or, microwave susceptor material can be applied directly to a package wall and can melt a ventilation hole through the wall when a specified amount of microwave energy has been applied.

10 Claims, 14 Drawing Sheets

(51) Int. Cl.
*B65D 51/16* (2006.01)
*B65D 33/00* (2006.01)

(52) U.S. Cl.
CPC ..... *B65D 2581/3427* (2013.01); *B65D 2581/3445* (2013.01); *B65D 2581/3497* (2013.01)

(58) Field of Classification Search
USPC ..... 219/725, 728, 730, 734, 739, 759; 426/107, 118, 234, 241, 243, 113, 242, 426/244, 245; 428/35.2, 145.1, 218, 457, 428/606, 36.6, 343; 99/451, DIG. 14
See application file for complete search history.

(56) References Cited

U.S. PATENT DOCUMENTS 6,055,786 A * 5/2000 Hubbard ..... E04D 5/12 116/205
6,814,991 B2 11/2004 Hiyoshi
2002/0132107 A1* 9/2002 O'Brien ..... B32B 38/0008 428/317.9
2004/0030384 A1* 2/2004 Wissman ..... B29C 65/1435 623/11.11
2007/0134382 A1 6/2007 Schmal
2008/0220212 A1 9/2008 Lin et al.
2009/0242550 A1 10/2009 Schneider
2009/0320684 A1* 12/2009 Weaver ..... A61M 1/1656 96/12
2011/0024412 A1 2/2011 Su et al.
2011/0059284 A1* 3/2011 Butzloff ..... B29C 65/1425 428/57
2011/0147377 A1 6/2011 Wnek et al.

FOREIGN PATENT DOCUMENTS

JP 2011111196 A * 6/2011
JP 2011111196 A 6/2011

OTHER PUBLICATIONS

Supplementary Partial European Search Report for Patent Appl. No. 18834502.9, dated Nov. 30, 2020, 12 Pages.
Office Action for European Patent Appl. No. 18834502.9, dated Apr. 3, 2021, 10 Pages.

* cited by examiner

PACKAGE FOR STORING AND COOKING FOOD WITH TEMPERATURE-ACTIVATED VENTILATION

RELATED APPLICATIONS

This application claims the benefit of U.S. Provisional Application No. 62/535,027, filed Jul. 20, 2017, which is herein incorporated by reference in its entirety for all purposes.

FIELD OF THE INVENTION

The invention relates to food packaging, and more particularly, to packaging in which food can be both stored and cooked without user manipulation.

BACKGROUND OF THE INVENTION

There is a strong desire in the marketplace for food storage and preparation solutions that allow consumers to select and store food items well in advance of their use, and then to prepare the food items when needed, all with a minimum of consumer manipulation. One approach is to provide food items in packaging that can be used both for storing and cooking the food, with little or no manipulation required by the user except to transfer the package from storage to the cooking environment, and then to open the package once cooking is complete. Cooking environments that are amenable to this approach include conventional ovens, pots of boiling water, and microwave ovens.

A common example of this approach is microwavable popcorn, which is typically sold in paper bags that can be stored for extended time periods if desired and then placed in a microwave oven for popping. Other examples include various plastic packaging solutions in which frozen food can be sold and stored, and which can be transferred directly from the freezer to boiling water or to a microwave oven for in-bag cooking.

An important necessity for food packaging that is used for both storage and cooking is the requirement to provide a mechanism for venting pressures that develop within the package during cooking due to expanding hot air and steam, so as to eliminate any danger that the package might burst open or explode during cooking. One approach is to provide instructions for the consumer to pierce the package before cooking. Another approach is to provide one or more appropriate ventilation holes in the package, and to cover the holes with an adhesive label that can be removed by the user before cooking. However, ventilation solutions that require a user to take some positive action before cooking are unpopular with many consumers, and also present a danger that the consumer may not take the required action, therefore running the risk that the package might burst open or explode during cooking.

Another popular approach is to provide a weakened region or other pressure sensitive feature in the package that will burst open automatically and allow steam and hot air to vent when the internal pressure of the package exceeds a certain level. Some of these approaches are actuated entirely by internal pressure, while others are actuated by a combination of internal pressure and a softening of an adhesive due to temperature. However, this approach requires that the food includes sufficient free moisture and/or cooks to a sufficient temperature such that the internal pressure in the package will cause the venting feature to open.

While adequate in some cases, this pressure-driven approach is not suitable in other cases where there may be insufficient free moisture to cause the venting feature to burst open, or the food may reach the desired state of cooking before sufficient heat and pressure are developed within the package. In such cases, a pressure-actuated venting approach may not be able to maintain a desired low internal pressure while the food cooks, and may not provide a visible indication when the cooking process is complete.

What is needed, therefore, is a package for storage and cooking of food which includes an automatic venting mechanism that does not require pressurization of the package for actuation.

SUMMARY OF THE INVENTION

A food storage and cooking package is disclosed which includes a venting mechanism that is actuated primarily or exclusively by temperature, rather than by pressure, thereby providing a storage and cooking solution that does not require user manipulation, and does not require a high water or high moisture content within the package. In embodiments, a temperature-related visual indication is provided by the venting mechanism that alerts a user as to the cooking status of the food contents.

The disclosed package is sometimes referred to herein as a "bag." However, it should be understood that the term "bag" is used generically herein to refer to any package that is able to contain food during both storage and cooking, such as a rigid tray having a lidding film sealed thereto.

In embodiments, the disclosed bag includes one or more ventilation holes that are covered by an impermeable label or patch that is adhered to the bag by a thermoplastic "hot melt" adhesive, which can be a pressure-sensitive adhesive that has a well-characterized glass transition temperature Tg, and therefore a well-characterized temperature at which the adhesive will soften and the patch will become partially or fully detached, or will form channels through the adhesive whereby the package is vented.

In some of these embodiments, a pressure sensitive adhesive is pattern-applied only on the rear face at the periphery of the patch or label, so that the center of the patch or label over the vent hole is free of adhesive. In other embodiments, an adhesive is applied uniformly to a patch or label, and then is deactivated in the region that overlaps the vent hole. For example, in embodiments a uniform layer of adhesive is applied to a sheet of label material and protected by a backing layer. Then, during the printing and manufacture of the patch or label, the center of the patch or label is deadened with an organic or inorganic coating, so that when the patch or label is applied to the package, only the perimeter of the patch or label is sealed to the bag, and the contents of the bag are not exposed to the adhesive over the vent hole region.

In some of these embodiments the adhesive is heated by convection due to heating of the air and/or moisture within the bag. In other embodiments that are useful for microwave cooking, a microwave absorbent material, referred to herein as a microwave "susceptor" material, such as activated aluminum flakes, carbon powder, or a microwave absorbent ceramic, is included in the adhesive, such that the adhesive is directly heated by applied microwaves and the patch detaches after a predetermined amount of microwave energy is applied to the bag.

In still other embodiments, a thermoplastic urethane (TPU) material is applied to cover the vent hole(s), for example using applied heat and pressure, such that no additional adhesive is required. The applied TPU is formulated to have a glass transition temperature Tg that will cause it to detach from the bag at a desired temperature, either due to convective heating by water vapor and/or hot air within the bag, or in embodiments due to direct heating of a microwave susceptor material included in the TPU.

In some embodiments, microwave susceptor material is applied to a non-porous label material, which can be a TPU, such that the susceptor material melts one or more holes in the label when sufficient microwave energy has been absorbed. In similar embodiments, at least a portion of the bag is made from a plastic or other material that will melt when heated by a susceptor material during cooking, and the microwave susceptor material is applied directly to the susceptor-meltable portion of the bag, for example using common printing techniques, such that one or more vent holes are formed when the susceptor material is sufficiently heated by applied microwaves and the underlying bag material is melted.

In various embodiments a porous material is used for the label or patch that covers the vent opening(s), and the pores of the patch are sealed by a crystallizable polymer or other material having a desired Tg or other thermal characteristics. In these embodiments, the patch itself remains adhered about its perimeter to the underlying bag, while "melting" of the applied sealant causes the pores in the patch material to be opened. In similar embodiments, a temperature sensitive ink is used to seal the pores in the patch.

For example, in embodiments the patch or label is made of a thermal laminate comprising a covering film applied to a non-woven or an open-mesh made of a material such as high density polyethylene (HDPE), which in some embodiments includes porous openings of at least ⅛" diameter distributed throughout the mesh or non-woven. In some of these embodiments, the covering film is a pore-blocking polymer that renders the label essentially impermeable to gases. In other embodiments, the covering film is a microporous film or microperforated film, such that a modified atmosphere packaging ("MAP") solution is provided that allows a limited exchange of gases between the bag interior and the outside environment during storage, thereby establishing a modified internal atmosphere when storing fresh, respiring produce so as to prolong the freshness of the produce.

The Tg or melting temperature of the covering layer is lower than the melting temperature of the HDPE mesh, so that when the package is heated in a microwave oven or other cooking environment, the covering layer peels or shrinks away from the underlying HDPE mesh and the package is vented.

A first general aspect of the present invention is a package suitable for containing a food item both during storage of the food item and during cooking of the food item. The package includes a container formed by at least one container wall, said container walls surrounding a package interior and being substantially impermeable to gasses, a ventilation hole penetrating one of the container walls, a sealing patch applied to the container wall so as to seal the ventilation hole, and a ventilation mechanism configured to unseal the ventilation hole when the container is heated to a specified venting temperature.

In embodiments, the ventilation mechanism includes adhesion of the sealing patch to the container wall by a thermoplastic adhesive having a glass transition temperature that causes the sealing patch to become unsealed when the container is heated to the specified venting temperature. Some of these embodiments, further include a microwave susceptor material in thermal communication with the adhesive and configured to directly warm the adhesive when the package is exposed to microwave heating.

In any of the preceding embodiments, the sealing patch can be made from a structurally competent, self-adhesive thermoplastic that is directly adhered to the wall of the package, the thermoplastic sealing patch having a glass transition temperature that causes the sealing patch to become unsealed when the container is heated to the specified venting temperature. In some of these embodiments, the sealing patch is made from a thermoplastic polyurethane (TPU).

In any of the preceding embodiments, the sealing patch can be made from a material that melts at a temperature that causes the sealing patch to become unsealed when the container is heated to the specified venting temperature. Some of these embodiments further include microwave susceptor material applied to the sealing patch and configured to cause at least a portion of the sealing patch to melt when sufficient microwave energy has been applied to the package to cause the container to be heated to the specified venting temperature.

In any of the preceding embodiments, the sealing patch can include a porous layer that is penetrated by a plurality of pores or microperforations, said pores or microperforations being sealed by a sealing material that flows out of the pores or microperforations when the container is heated to the specified venting temperature, thereby allowing the package interior to be vented through the venting hole and the pores or microperforations. In some of these embodiments, the sealing material is a crystallizable polymer. In other of these embodiments, the sealing material is a temperature sensitive ink. And in some of these embodiments, the sealing patch is a packaging label, and the temperature sensitive ink presents a visible indicia on the packaging label.

In any of these embodiments that includes a porous layer that is penetrated by a plurality of pores or microperforations, the porous layer can remain adhered to the package wall after the package interior has been vented through the pores. In any of these embodiments, the porous layer can be made from an open-mesh or non-woven high density polyethylene (HDPE). And in some of these embodiments the porous layer includes pores having diameters of at least ⅛ inches.

In any of these embodiments the sealing material can be a sealing layer that is laminated onto the porous layer. And in some of these embodiments the sealing layer is substantially impermeable to gasses. And in any of these embodiments, the sealing layer can be microporous or microperforated, so as to provide limited gas permeability, thereby enabling a modified atmosphere having an $O_2$ concentration less than 20.9% $O_2$ and $CO_2$ concentration of greater than 0.3% to be established in the package interior when fresh, respiring produce is contained within the package.

A second general aspect of the present invention is a package suitable for containing a food item both during storage of the food item and during microwave cooking of the food item. The package includes a container formed by at least one container wall surrounding a package interior, said container walls being substantially impermeable to gasses, said container walls being made from a material that melts when heated to a specified venting temperature, and a microwave susceptor material applied to a ventilation region of one of the container walls and configured to heat the ventilation region to the specified venting temperature when a specified quantity of microwave energy has been applied to the package.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a food storage and cooking package which includes a venting mechanism that is actuated primarily or exclusively by temperature rather than by pressure, thereby providing a storage and cooking solution that does not require user manipulation, and does not require a high free moisture content within the package, where free moisture is defined as moisture that is converted into heated vapor during cooking. In embodiments, a temperature-related visual indication is provided by the venting mechanism that alerts a user as to the cooking status of the food contents.

The disclosed package is sometimes referred to herein as a "bag." However, it should be understood that the term is used generically herein to refer to any package that is able to contain food during storage and during cooking, including a rigid tray that includes a lidding film sealed thereto.

Figure 1A:
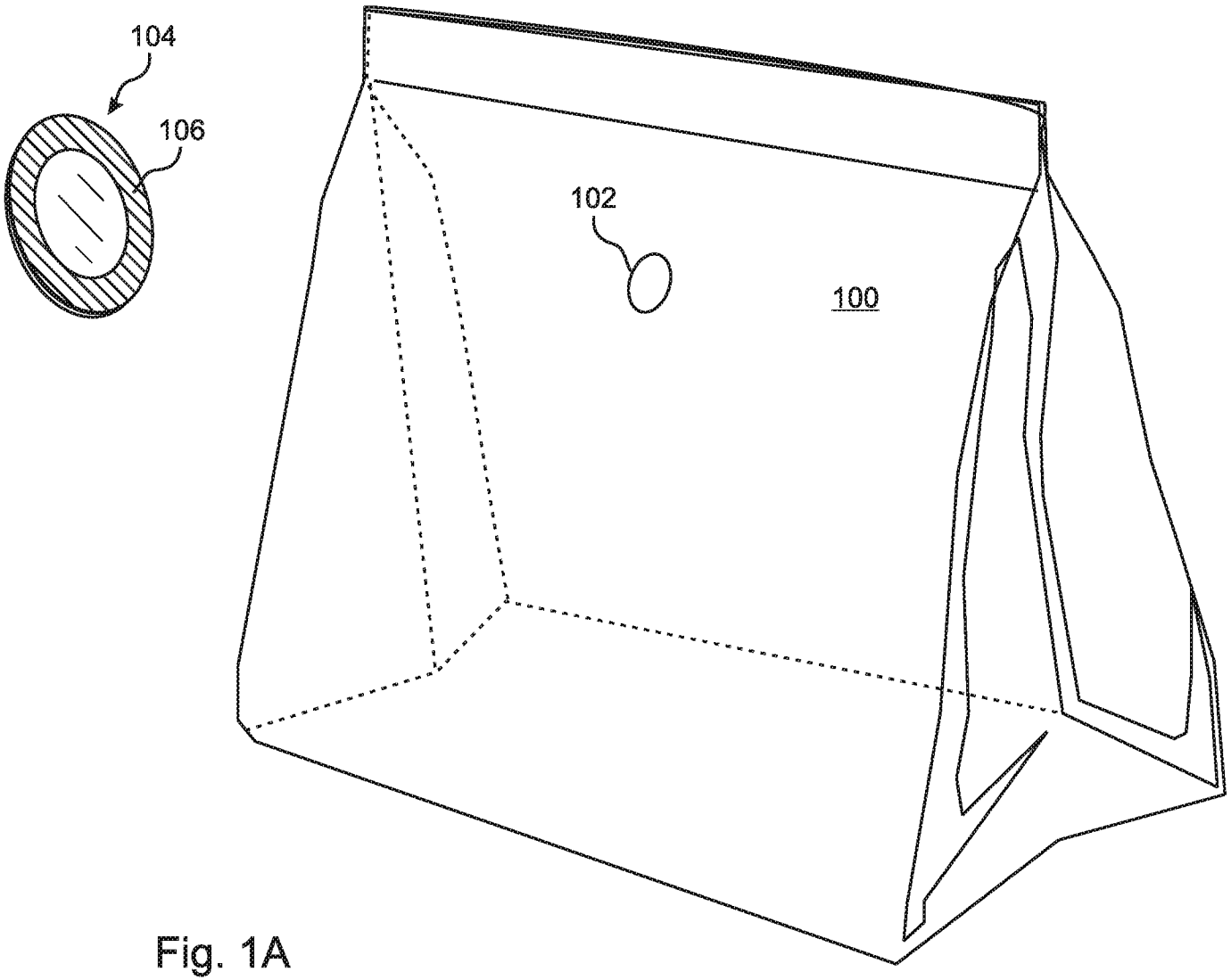
FIG. 1A is a perspective view of a package having a ventilation hole shown beside a sealing patch in an embodiment of the invention where the patch is attachable to the bag by a thermoplastic adhesive.
Figure 1B:
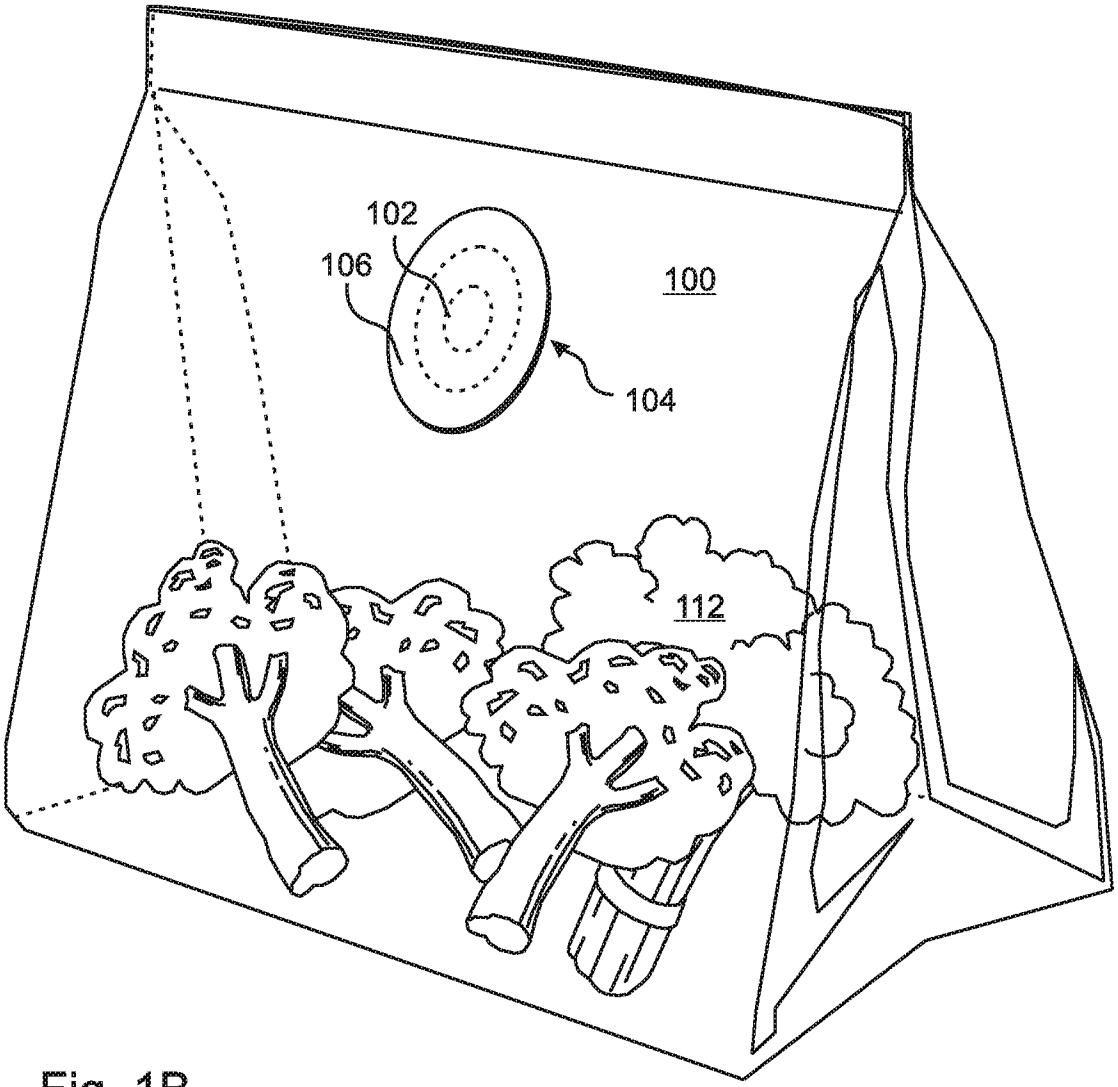
FIG. 1B is a perspective view of the package of FIG. 1A shown with the patch attached to the bag.
Figure 1C:
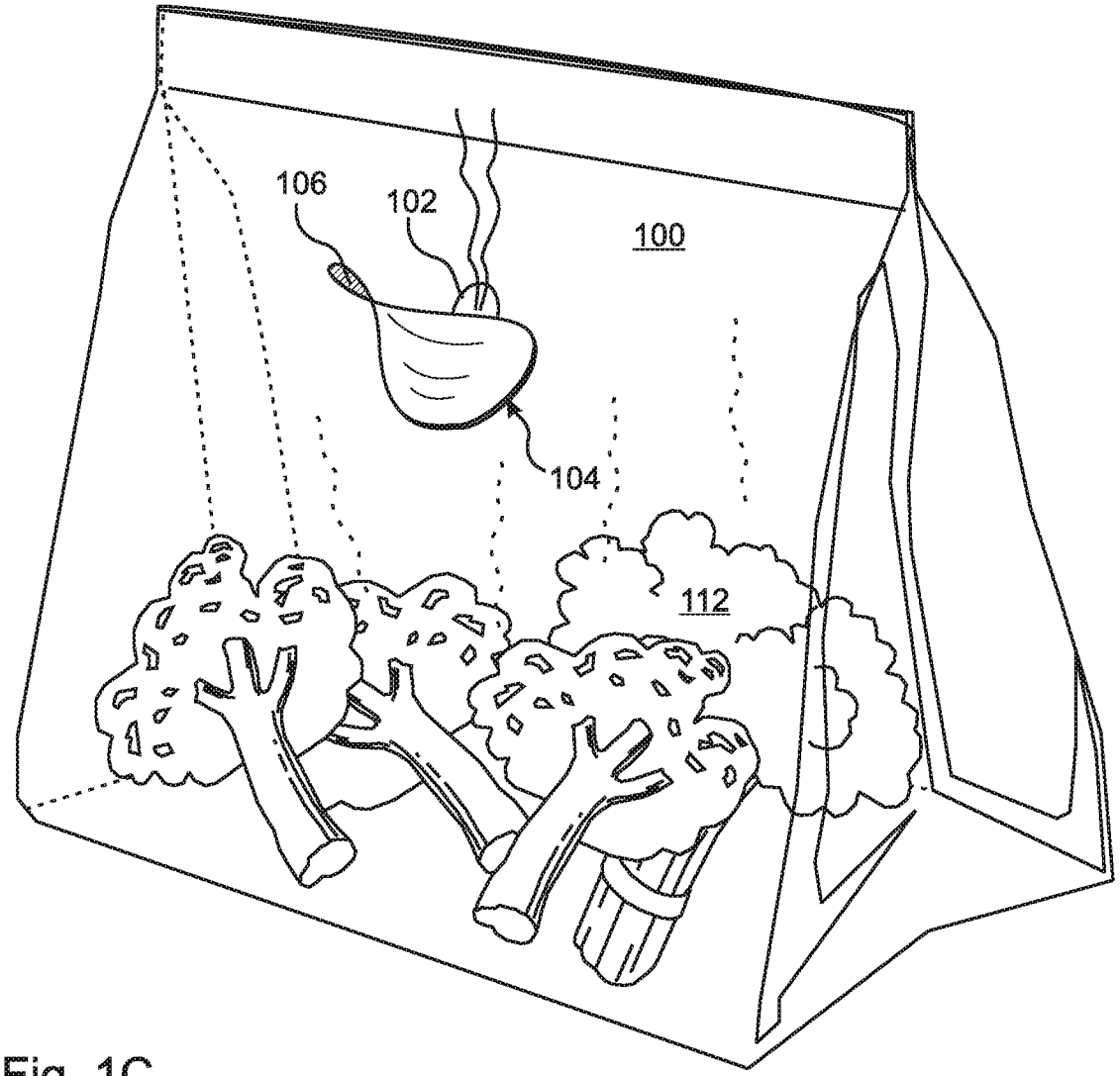
FIG. 1C is a perspective view of the package of FIG. 1B shown after heating and partial detachment of the patch.
Figure 1D:
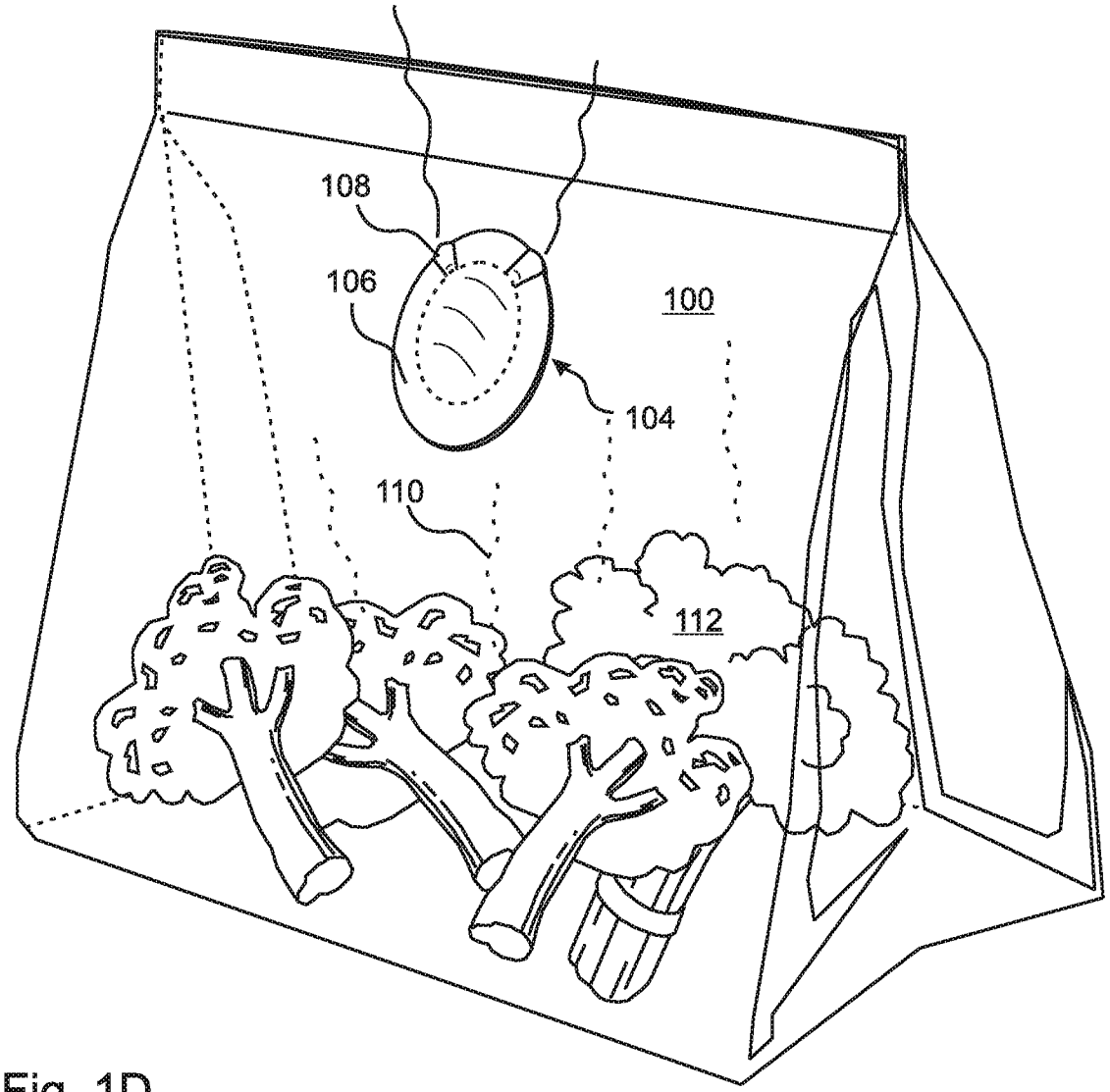
FIG. 1D is a perspective view of an embodiment similar to FIG. 1C shown after heating of the patch has caused ventilation channels to form in the patch adhesive.

With reference to FIGS. 1A and 1B, in embodiments the disclosed bag 100 includes one or more ventilation holes 102 that are covered by an impermeable label or patch 104 that is adhered to the bag by a thermoplastic adhesive 106, which can be a pressure-sensitive adhesive, that has a well-characterized glass transition temperature Tg, and therefore a well-characterized temperature at which the adhesive 106 will soften and the patch 104 will become partially or fully detached, as shown in FIG. 1C, and/or channels 108 will be formed through the surrounding adhesive whereby the package is vented, as shown in FIG. 1D. In some of these embodiments the adhesive is heated by convection due to heating of the air and/or moisture 110 within the bag 100.

In some of these embodiments, the thermoplastic adhesive 106 is applied only on the rear face of the label or patch 104 at its periphery, so that the center of the patch or label 104 over the vent hole 102 is free of adhesive. In other embodiments, an adhesive 106 is applied uniformly to the patch or label 104, and then is deactivated in the region that overlaps the vent hole 102. For example, in embodiments a uniform layer of adhesive 106 is applied to a sheet of label material and protected by a backing layer. During manufacture, the patches or labels 104 are cut or stamped from the sheet of material, the backing layers are removed from the patches 104, and a blocking gel or powder, or a small backing plate, is applied to the center of each patch 104, so that after the patch 104 is applied to the bag 100, the perimeter of the patch 104 is sealed to the bag 100, but the contents 112 of the bag are not exposed to the adhesive.

Figure 2:
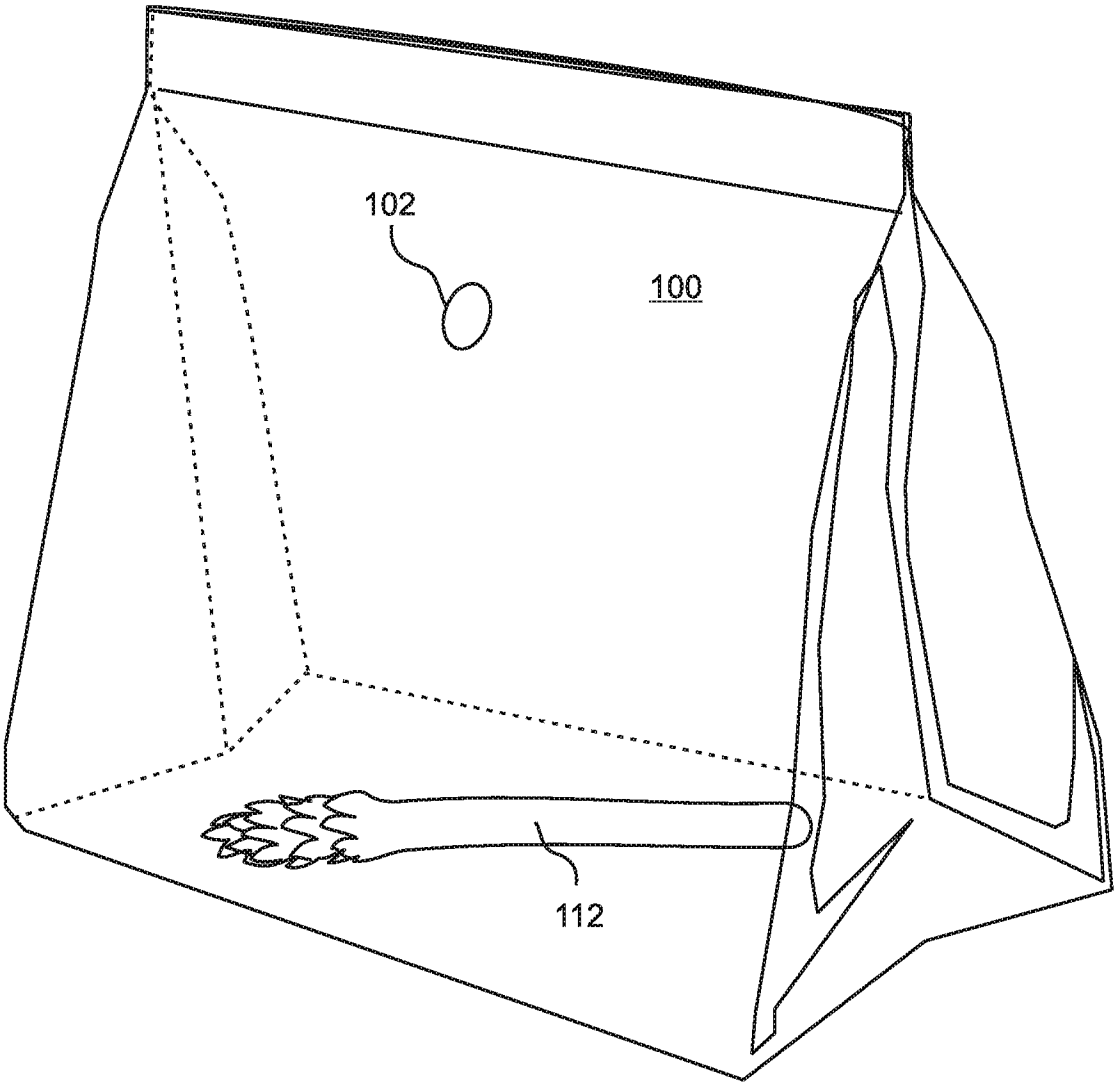
FIG. 2 is a perspective view of an embodiment similar to FIG. 1A, wherein a microwave-absorbing susceptor material has been added to the thermoplastic adhesive.
Figure 2:
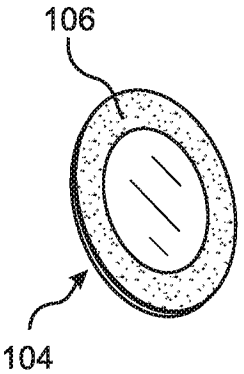

With reference to FIG. 2, in other embodiments that are useful for microwave cooking, a microwave absorbent material, referred to herein as a microwave "susceptor" material, such as activated aluminum flakes, carbon powder, or a microwave absorbent ceramic, is mixed with the adhesive 106, such that the adhesive 106 is directly heated by applied microwaves and the patch 104 detaches from the bag 100 after a predetermined amount of microwave energy has been applied.

Figure 3A:
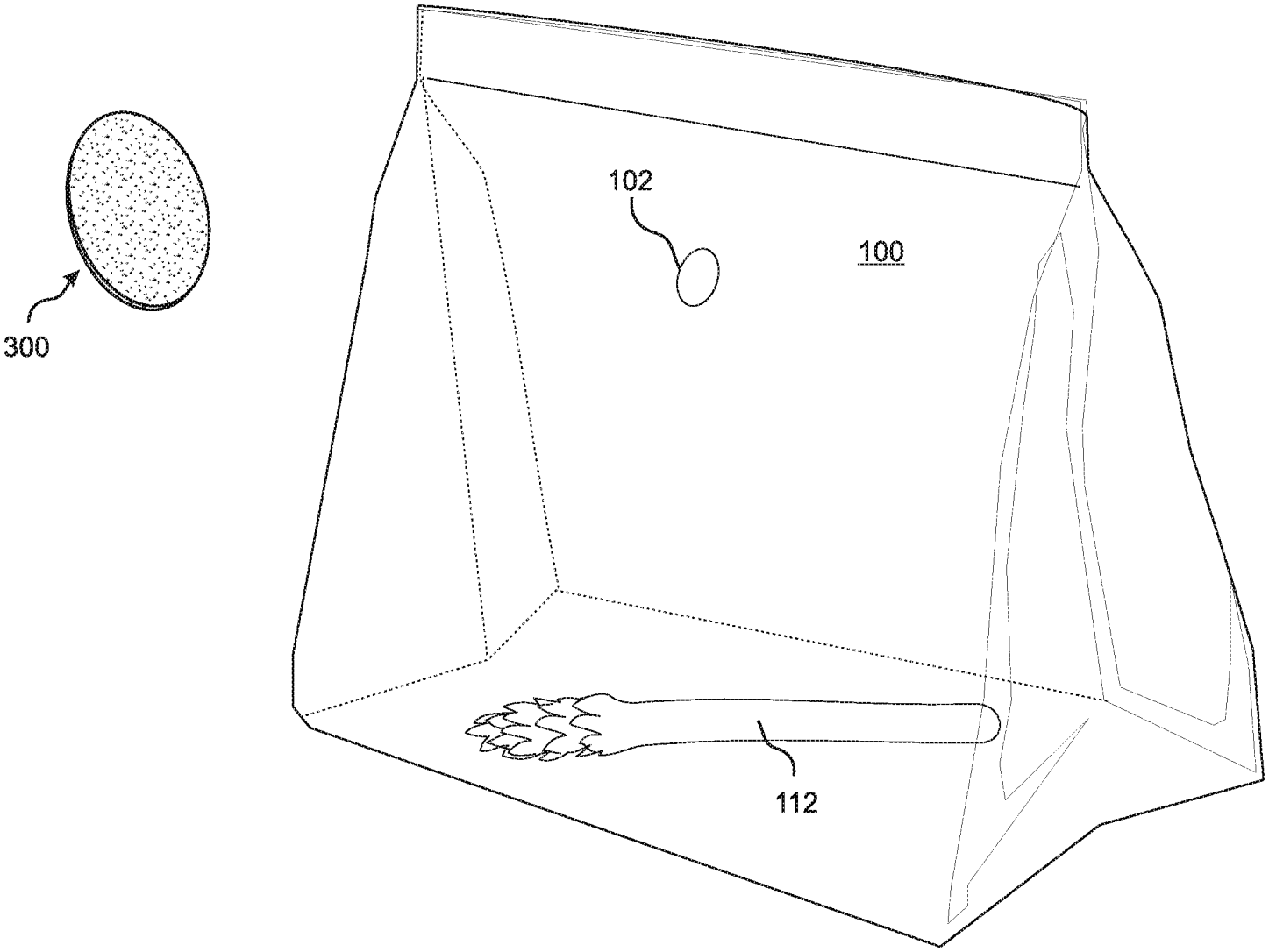
FIG. 3A is a perspective view of a package having a ventilation hole shown beside a sealing patch in an embodiment of the invention where the patch is made from a mechanically competent thermoplastic polyurethane that is self-adhesively applicable to the bag by application of pressure and heat to the patch.
Figure 3B:
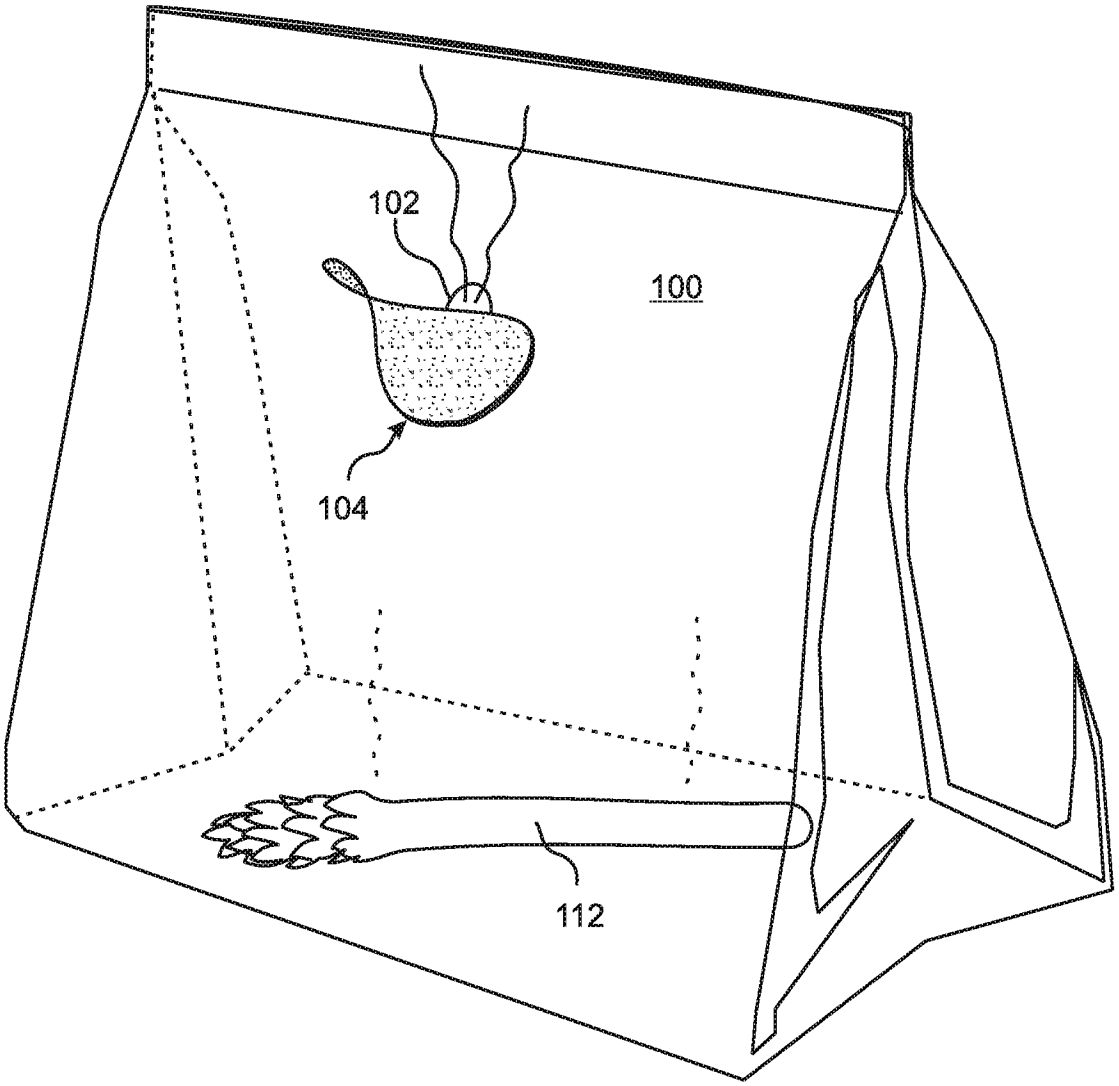
FIG. 3B is a perspective view of the package of FIG. 3A shown after heating and partial detachment of the patch.

With reference to FIG. 3A, in still other embodiments, a patch 300 made of thermoplastic urethane (TPU) material is applied to cover the vent hole(s) 102, for example using applied heat and pressure, such that no additional adhesive is required. The applied TPU 300 is formulated to have a glass transition temperature Tg that will cause the TPU patch 300 to detach from the bag 100, as shown in FIG. 3B, at a desired temperature, either due to convective heating by water vapor and/or hot air with in the bag, or in embodiments due to direct heating of a microwave susceptor material included in the TPU 300.

Figure 4A:
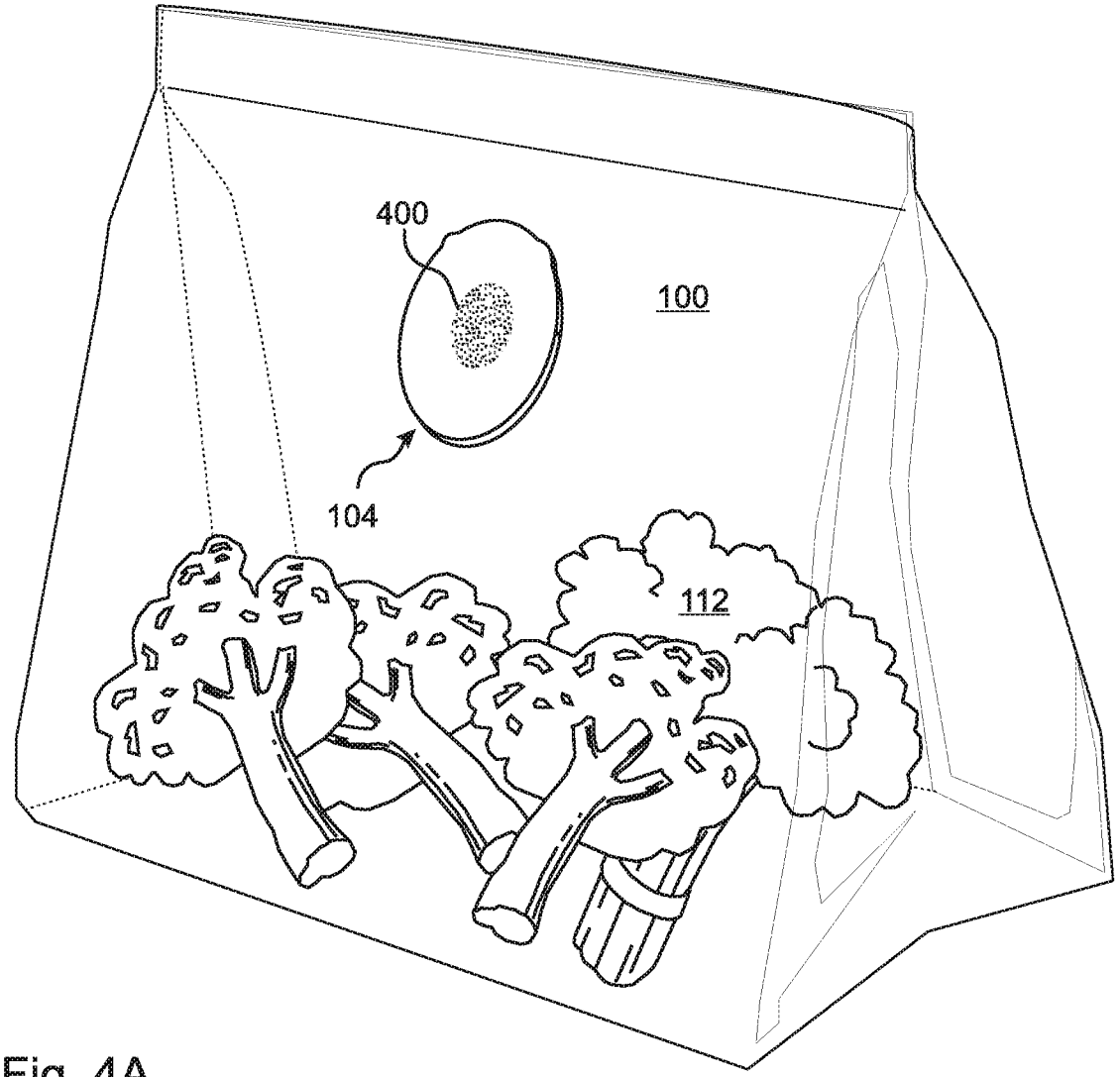
FIG. 4A is a perspective view of an embodiment wherein the sealing patch is made from a susceptor-meltable plastic to which a microwave absorbing susceptor material has been applied.
Figure 4B:
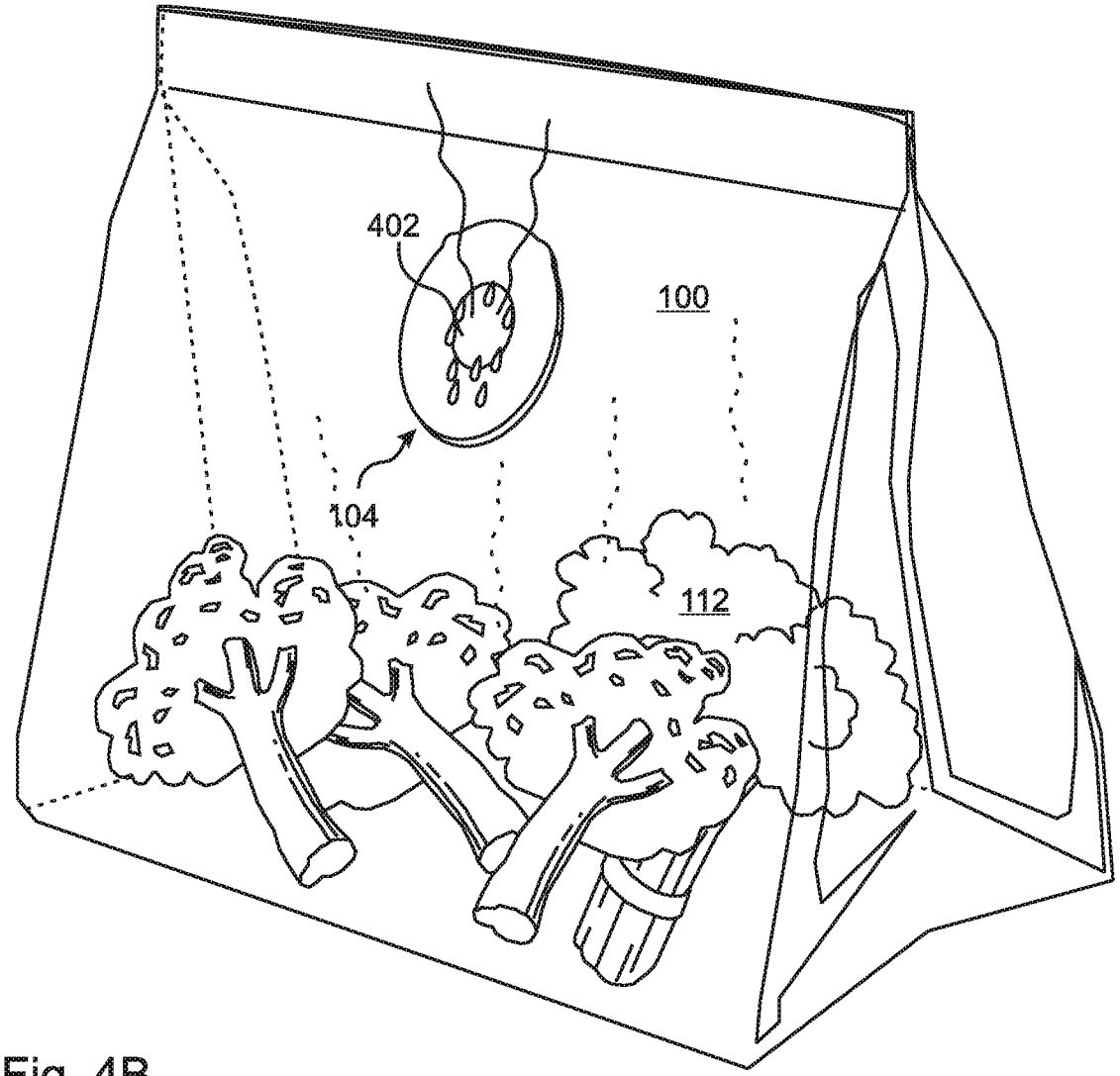
FIG. 4B is a perspective view of the embodiment of FIG. 4A shown after the susceptor material has been heated by microwaves and has melted a hole through the patch.
Figure 4C:
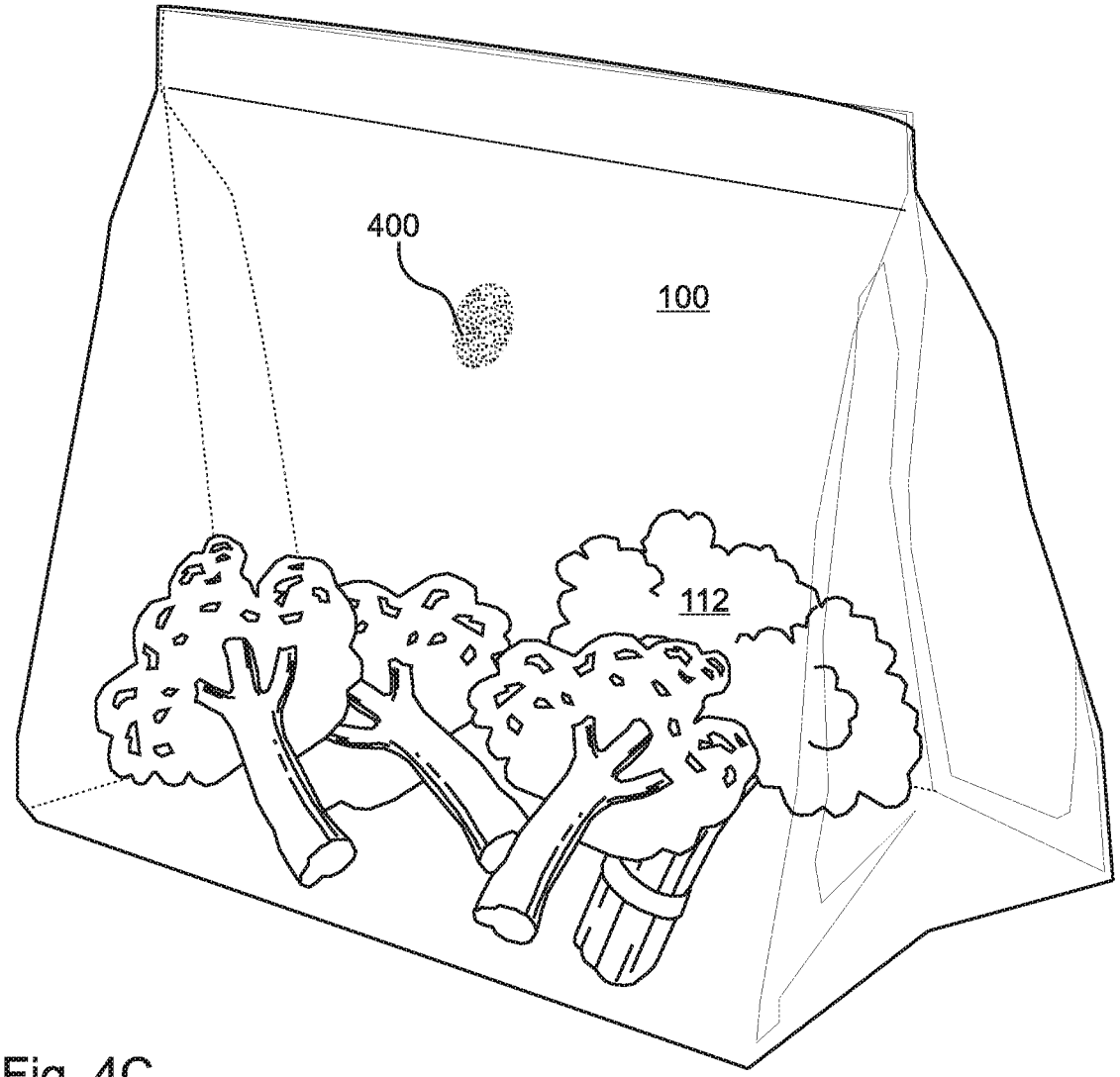
FIG. 4C is a perspective view of an embodiment similar to FIG. 4A, wherein the microwave susceptor material is applied directly to a susceptor-meltable region of a wall of the package.
Figure 4D:
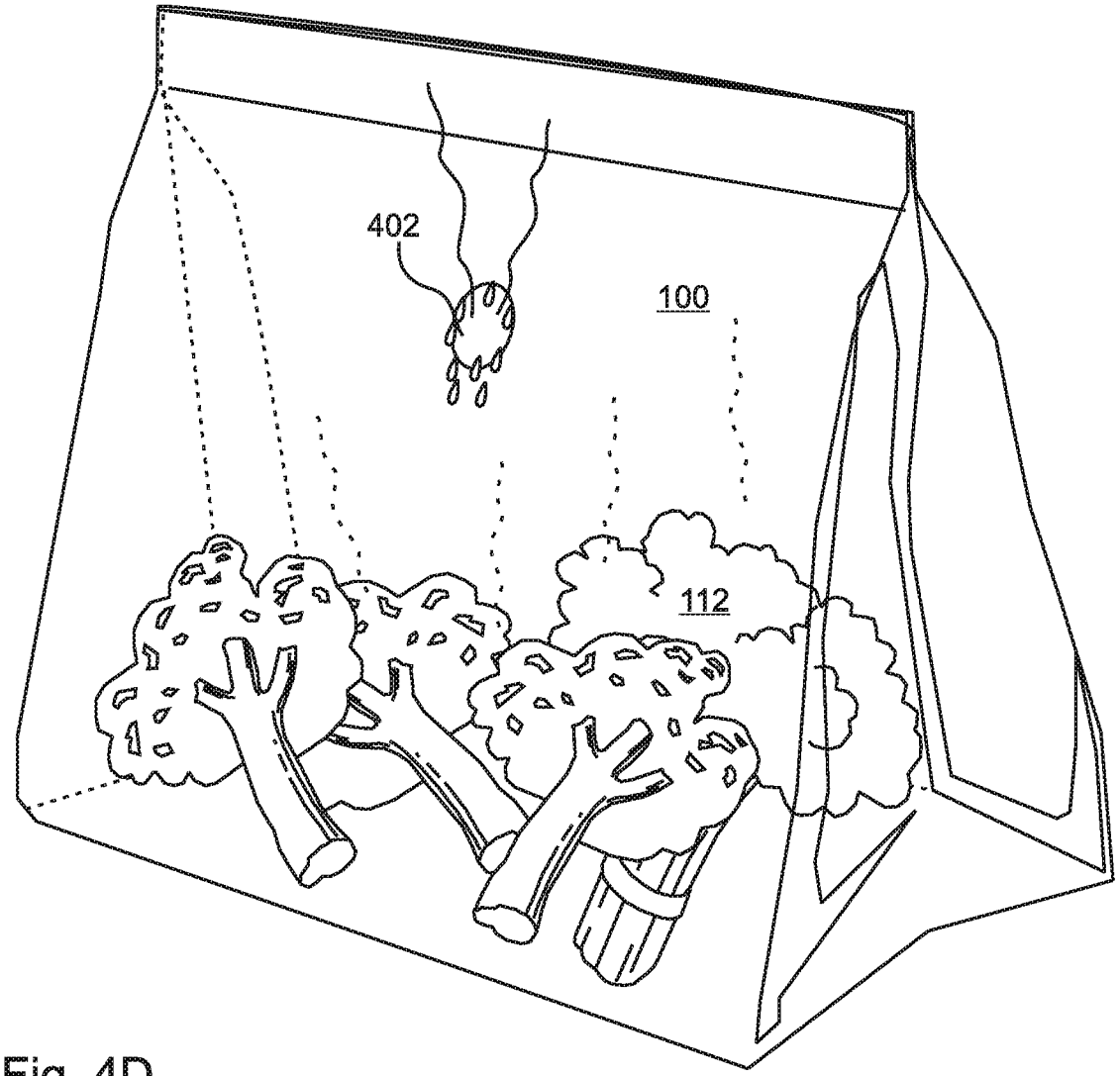
FIG. 4D is a perspective view of the embodiment of FIG. 4C shown after the susceptor material has been heated by microwaves and has melted a hole through the package wall.

With reference to FIG. 4A, in some embodiments microwave susceptor material 400 is applied to a non-porous label material 104, which can be a TPU, such that the susceptor material 400 melts one or more holes 402 in the label 104 when sufficient microwave energy has been absorbed, as shown in FIG. 4B. In similar embodiments, with reference to FIG. 4C, at least a portion of the bag 100 is made from a plastic or other material that will melt when heated, and the microwave susceptor material 400 is applied directly to the susceptor-meltable portion of the bag 100, such that one or more vent holes 402 are formed when the susceptor material is sufficiently heated by applied microwaves and the underlying bag material is melted, as shown in FIG. 4D.

Figure 5B:
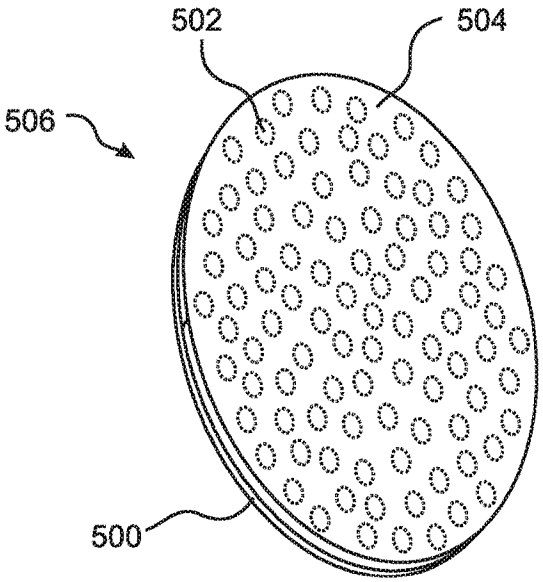
FIG. 5B is a perspective view of the assembled patch of FIG. 5A, shown from above.
Figure 5C:
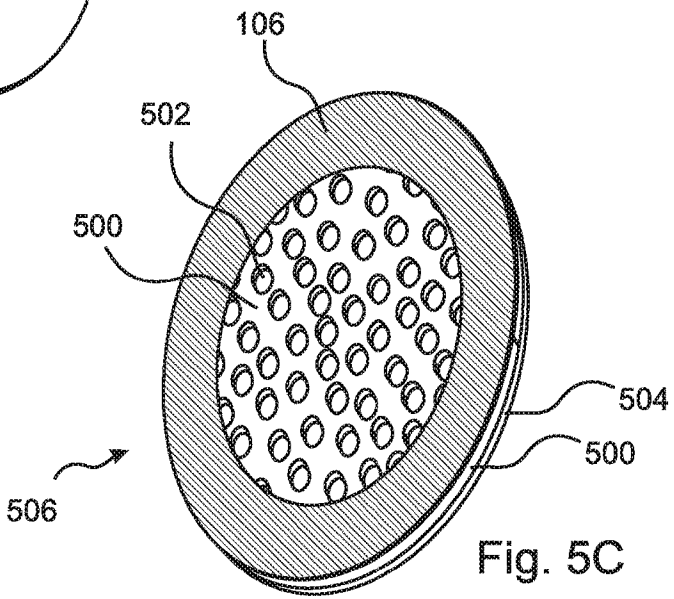
FIG. 5C is a perspective view of the assembled patch of FIG. 5A, shown from below, whereby the applied adhesive is visible.
Figure 5A:
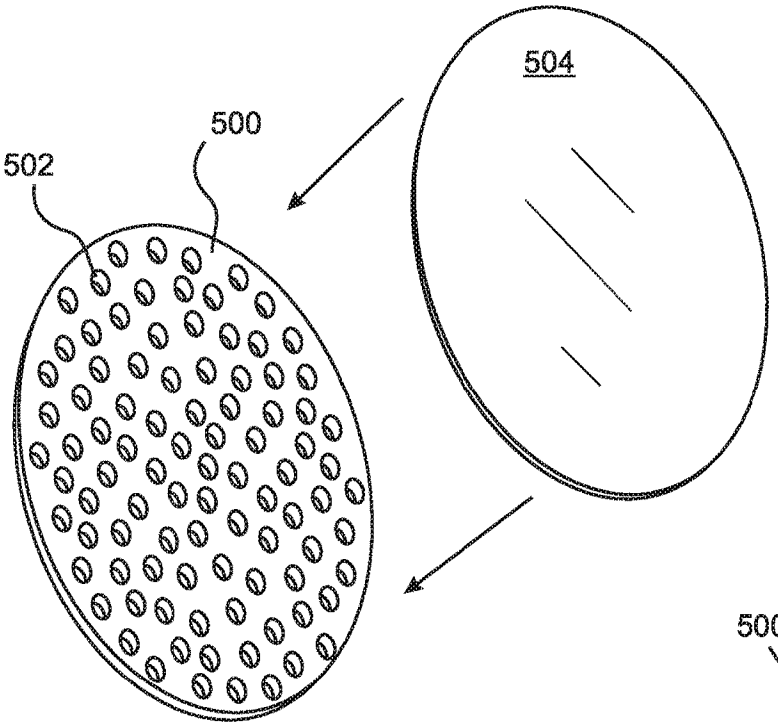
FIG. 5A is an exploded view of a laminate patch that includes a porous layer and a pore-sealing layer.
Figure 5D:
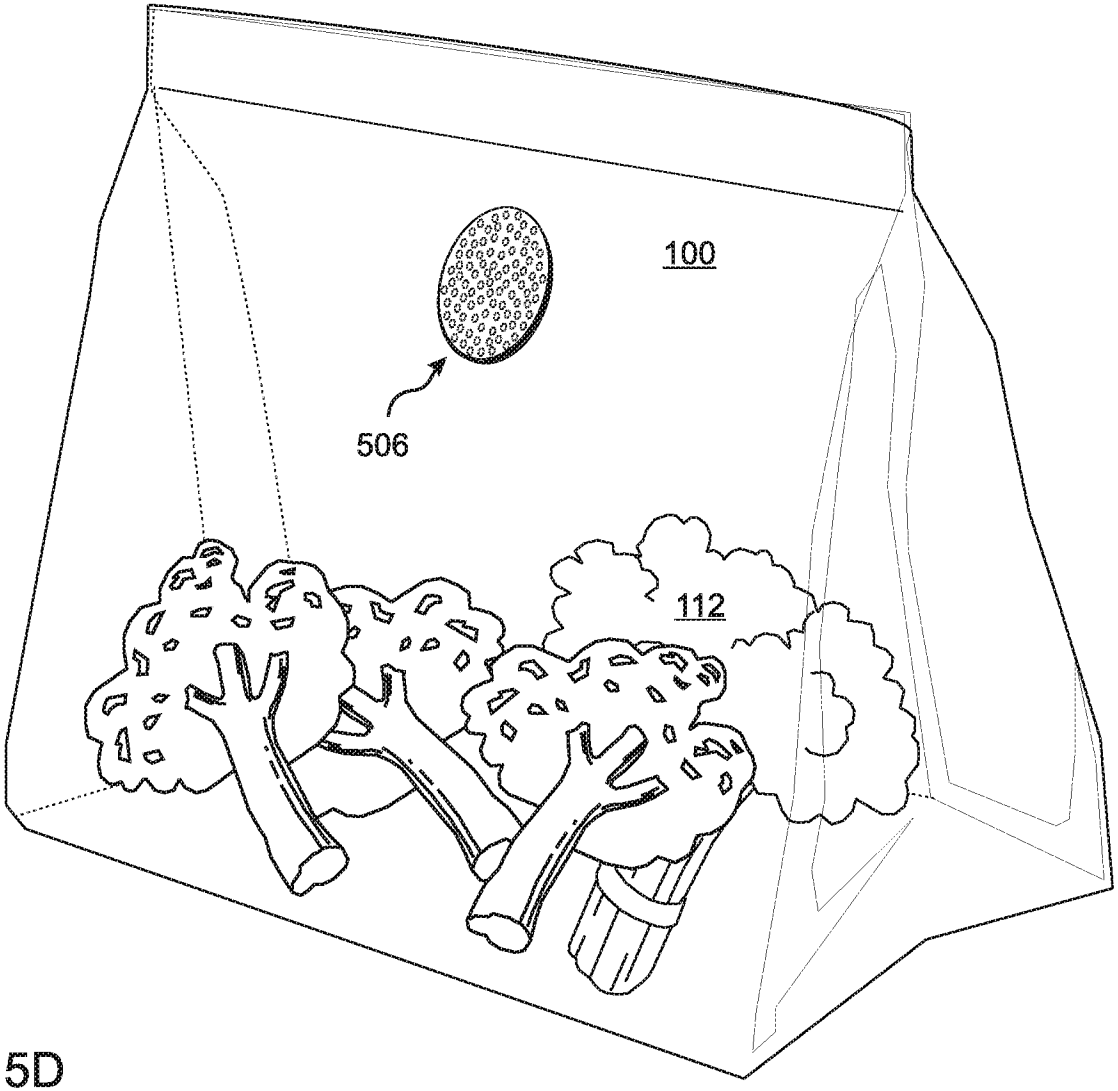
FIG. 5D is a perspective view of the patch of FIG. 5B applied to seal a vent hole in a package according to an embodiment of the invention.
Figure 5E:
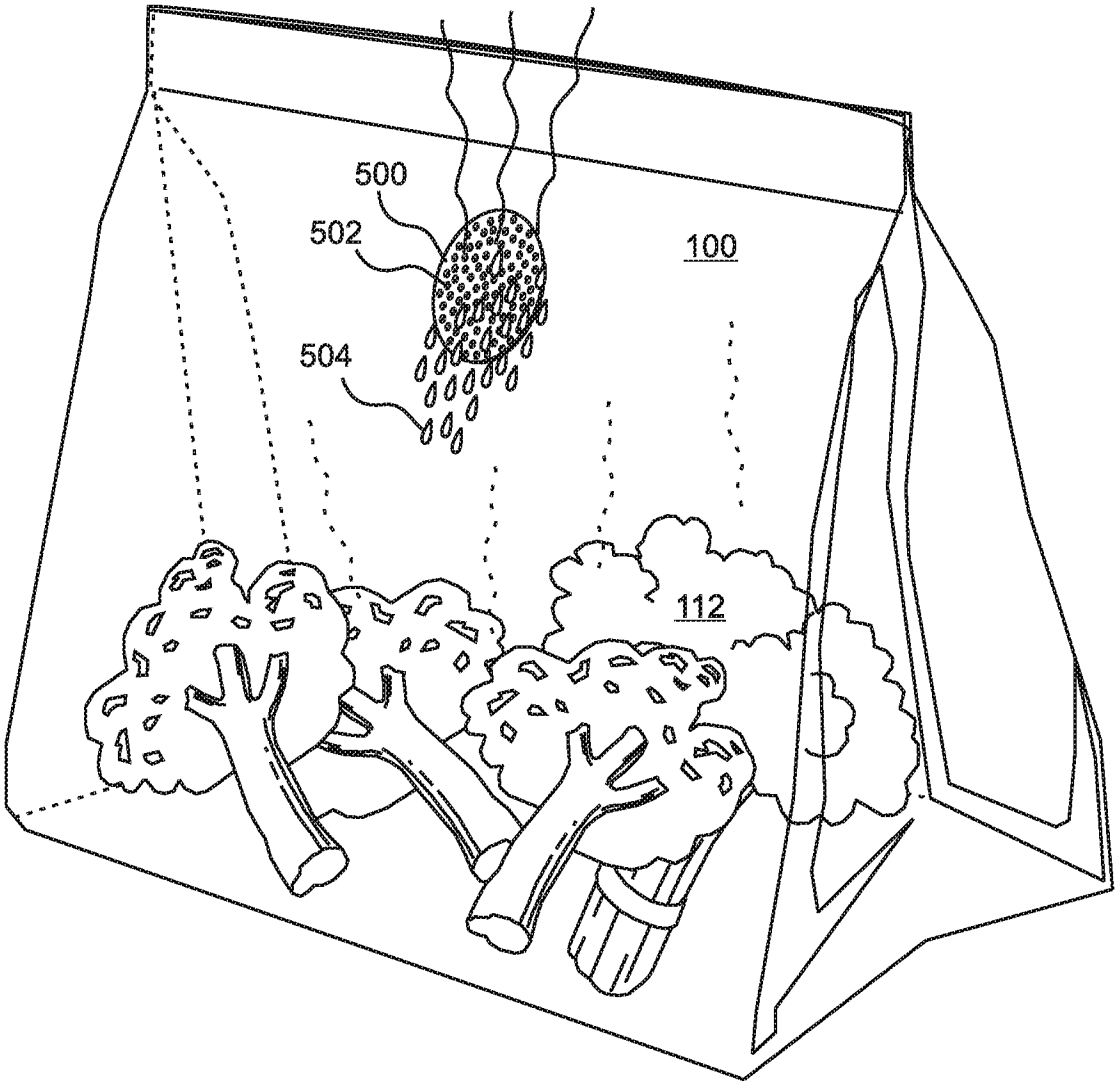
FIG. 5E is a perspective view of the embodiment of FIG. 5D, shown after the patch has been heated and the sealing layer has melted, allowing the package interior to be vented through the pores of the porous layer.

In various embodiments, with reference to FIGS. 5A through 5D, a porous material 500 is used for the label or patch 506. The pores 502 of the patch material 500 are sealed by a crystallizable polymer or other material 504 having a desired Tg or other thermal characteristics. With reference to FIG. 5E, the patch 506 covers the vent opening (s) 102, and in these embodiments the patch material 500 remains adhered about its perimeter 106 to the underlying bag 100, while "melting" of the applied sealant 504 causes the pores 502 in the patch material 500 to be opened. In similar embodiments, a temperature sensitive ink is used to seal the pores in the patch.

In some of these embodiments, the patch or label 506 is made of a thermal laminate comprising a covering film 504 applied to an open-mesh or non-woven, high density polyethylene (HDPE) 500, which in some embodiments includes mesh openings 502 of at least ⅛" diameter distributed throughout the mesh or non-woven 500. In the embodiment of FIGS. 5A through 5C, a pressure sensitive adhesive 106 is applied to the rear face of the label or patch 506 only on the periphery of the patch or label 506, so that the center of the patch or label 506 above the vent hole 102 is free of adhesive 106. In other embodiments, as discussed above, the adhesive 106 is applied uniformly to the rear surface of the patch or label 104, but is deactivated in a central region so that the interior of the bag 100 is not exposed to the adhesive 106 through the vent hole 102. For example, in embodiments a uniform layer of adhesive is applied to a sheet of label material and protected by a backing layer. Then, during the printing and manufacture of the patch or label 506, the center of the patch or label 506 is deadened with an organic or inorganic coating, so that when the patch or label 506 is applied to the package 100, only the perimeter of the patch or label 506 is sealed to the bag 100, and the contents of the bag 100 are not exposed to the adhesive over the vent hole region 102.

In some of these embodiments, the covering film 504 is a pore-blocking polymer that renders the label 506 essentially impermeable to gases. In other embodiments, the covering film 504 is a microporous film or microperforated film, configured so that a modified atmosphere packaging ("MAP") solution is provided that allows a limited exchange of gases between the environment and the interior of the bag during refrigerated storage, thereby establishing a modified internal atmosphere, such as an atmosphere having an O2 concentration less than 20.9% O2 and CO2 concentration of greater than 0.3%, when storing fresh, respiring produce 112, so as to prolong the freshness of the produce 112.

The Tg or melting temperature of the covering layer 504 is lower than the temperature of the HDPE mesh or non-woven 500, so that when the package 100 is heated in a microwave oven or other cooking environment, the covering layer 504 peels or shrinks away from the underlying HDPE mesh or non-woven 500 and the package 100 is vented.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

The invention illustratively disclosed herein suitably may be practiced in the absence of any element which is not specifically disclosed herein and is not inherently necessary. However, this specification is not intended to be exhaustive. Although the present application is shown in a limited number of forms, the scope of the invention is not limited to just these forms, but is amenable to various changes and modifications without departing from the spirit thereof. One of ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

What is claimed is:

1. A package suitable for containing a food item both during storage of the food item and during cooking of the food item, the package comprising:

a container formed by at least one container wall, said container walls surrounding a package interior and being substantially impermeable to gasses;

a ventilation hole penetrating one of the container walls; and a sealing patch applied to the container wall so as to seal the ventilation hole; wherein the sealing patch comprises a porous layer that is penetrated by a plurality of pores or microperforations, said pores or microperforations being sealed by a sealing material that flows out of the pores or microperforations due solely to gravity when the container is heated to the specified venting temperature, thereby allowing the package interior to be vented through the venting hole and the pores or microperforations.

2. The package of claim 1, wherein the sealing material is a crystallizable polymer.

3. The package of claim 1, wherein the sealing material is a temperature sensitive ink.

4. The package of claim 3, wherein the sealing patch is a packaging label, and the temperature sensitive ink presents a visible indicium on the packaging label.

5. The package of claim 1, wherein the porous layer remains adhered to the package wall after the package interior has been vented through the pores.

6. The package of claim 1, wherein the porous layer is made from an open-mesh or non-woven high density polyethylene (HDPE).

7. The package of claim 6, wherein the porous layer includes pores having diameters of at least ⅛ inches.

8. The package of claim 1, wherein the sealing material is a sealing layer that is laminated onto the porous layer.

9. The package of claim 8, wherein the sealing layer is substantially impermeable to gasses.

10. The package of claim 8, wherein the sealing layer is microporous or microperforated, so as to provide limited gas permeability, thereby enabling a modified atmosphere having an $O_2$ concentration less than 20.9% $O_2$ and $CO_2$ concentration of greater than 0.3% to be established in the package interior when fresh, respiring produce is contained within the package.

* * * * *